United States Patent [19]

Gunnels et al.

[11] Patent Number: 4,771,257

[45] Date of Patent: Sep. 13, 1988

[54] BALLAST TRANSFORMER WITH BOBBINS COILS

[75] Inventors: William F. Gunnels, Hendersonville; Candler A. Willis; Mitchell M. Osteen, both of Zirconia, all of N.C.

[73] Assignee: General Electric Company, Schenectady, N.Y.

[21] Appl. No.: 125,657

[22] Filed: Nov. 27, 1987

Related U.S. Application Data

[60] Division of Ser. No. 091,562, Aug. 31, 1987, Pat. No. 4,730,178, which is a continuation of Ser. No. 912,676, Sep. 25, 1986, Pat. No. 4,721,935, which is a continuation of Ser. No. 652,233, Sep. 19, 1984, abandoned.

[51] Int. Cl.[4] ..... H01F 21/08; H01F 27/30

[52] U.S. Cl. ..... 336/160; 174/DIG. 2; 336/212

[58] Field of Search ..... 310/71; 336/155, 160, 336/165, 192, 198, 208, 212, 185; 174/DIG. 2; 29/605

[56] References Cited

U.S. PATENT DOCUMENTS

| | | | |
|---|---|---|---|
| 3,135,938 | 6/1964 | Davis | 336/165 |
| 3,709,457 | 1/1973 | Church | 249/91 |
| 3,959,675 | 5/1976 | Lautner et al. | 336/192 |
| 3,979,615 | 9/1976 | Neff | 310/71 |
| 4,038,573 | 7/1977 | Hillyer et al. | 310/71 |
| 4,132,913 | 1/1979 | Lautner et al. | 336/192 X |
| 4,151,500 | 4/1979 | Malerba et al. | 336/192 X |
| 4,156,222 | 5/1979 | Rossman et al. | 336/155 X |
| 4,157,519 | 6/1979 | Foster | 336/192 |
| 4,166,265 | 8/1979 | Reynolds et al. | 336/192 |
| 4,183,002 | 1/1980 | Haslau | 336/192 |
| 4,353,051 | 10/1982 | Wille et al. | 336/192 |
| 4,419,814 | 12/1983 | Hasserjian | 336/198 X |

*Primary Examiner*—Thomas J. Kozma

*Attorney, Agent, or Firm*—John P. McMahon; Philip L. Schlamp; Fred Jacob

[57] ABSTRACT

Coil bobbins are disclosed having flanged coil support portions provided with outboard terminal housings projecting beyond the flange rim and defining inwardly extending terminal-receiving cavities. The end walls of the housings are slotted to allow a wire to pass through the cavity in a circumferential direction relative to the winding axis in similar fashion to a turn of coiling. Bifurcated terminals pressed into the cavities in straddling relationship to the wire provide connections to the coil.

A double bobbin has twin flanged coil support portions with bridging sections maintaining their physical separation. Terminal housings are provided on the bridging sections allowing wire to be first wound into a coil on one support portion, guided across the bridging section and passed through the cavity in a terminal housing, and then wound into a coil on the other support portion, all without interruption.

3 Claims, 3 Drawing Sheets

Fig. 1
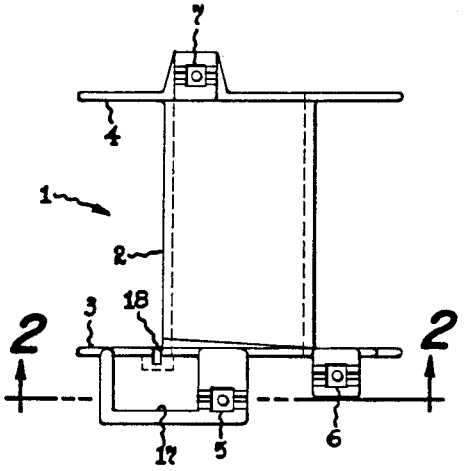
Fig. 3
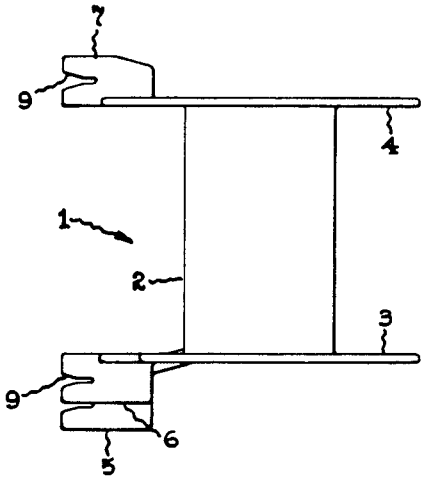
Fig. 2
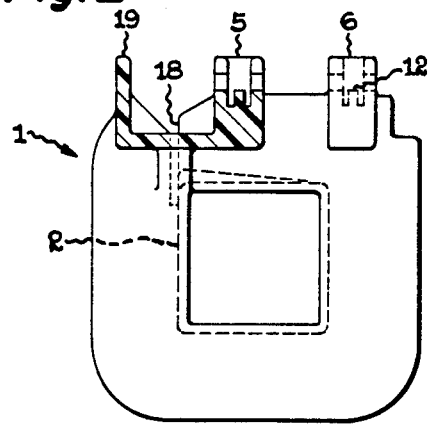
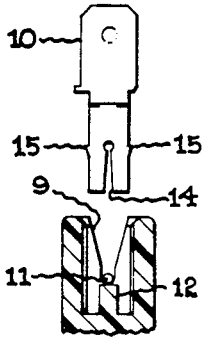
Fig. 4a
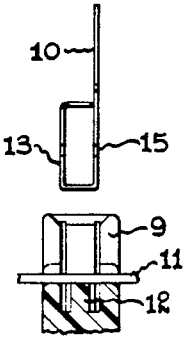
Fig. 4b
Fig. 6
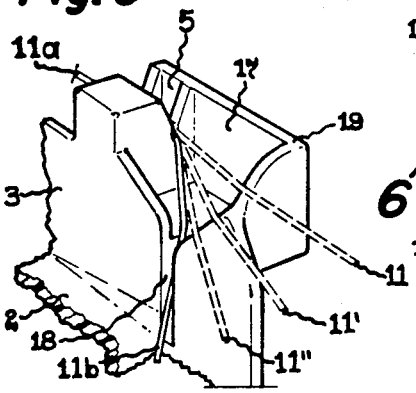
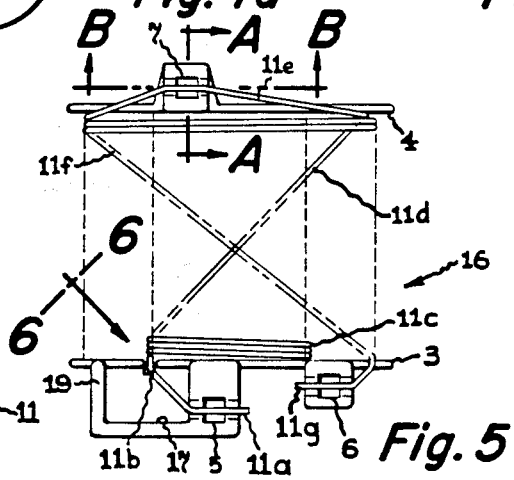
Fig. 5

BALLAST TRANSFORMER WITH BOBBINS COILS

This is a division, of application Ser. No. 091,562, filed Aug. 31, 1987, now U.S. Pat. No. 4,730,178 which is a continuation of application Ser. No. 912,676 filed Sept. 25, 1986, now U.S. Pat. No. 4,721,935, which, in turn is a continuation of patent application Ser. No. 652,233 filed Sept. 19, 1984, now abandoned.

The invention relates to electrical coils and bobbins therefor and to methods of manufacturing electrical coil assemblies, and will be described herein with particular reference to core and coil assemblies intended for use as ballasts for electrical discharge lamps.

BACKGROUND OF THE INVENTION

In the manufacture of electrical coils, it has been common practice to provide metal terminals in the flanges of the coil bobbins. The operator attaches the wire to one terminal, winds the required number of turns, and then ties the wire to the other terminal and severs it. But when a tap is required, the operator must stop winding, draw a loop, and attach it to another terminal before resuming winding.

By way of example, winding may be done on a semi-automatic machine of the kind comprising a rotating arbor on which the bobbin is mounted, and a traversing wire guide which feeds the wire under controlled tension to the bobbin. The winder may have a controller which has programmed into it the number of turns per layer and the number of layers in the winding. To make a coil, the operator twists the end of the wire around the appropriate terminal on the bobbin and pushes the start button. Typically the machine winds the first layer at low speed before switching to high speed; the controller stops the machine whenever a tap must be made. At such time, the operator pulls a length of wire from the guide to make a loop, directs it to the appropriate terminal location, and then restarts the machine. This is repeated for as many taps as are needed. Finally the machine stops at the end of the winding, the wire is attached to the last terminal and severed. The operator then removes the bobbin from the arbor, trims the excess wire from the terminals and solders the wire ends to the terminals by dipping into a solder bath. Alternatively contact terminals may be used which do not require soldering, but which are crimped to penetrate the insulating varnish on the wire and establish electrical contact.

Winding machines are also used in which the bobbin is mounted on a stationary arbor and the wire is supplied to a rotating winding head which wraps it around the bobbin. With these machines too, the same need is present of having to stop winding whenever a tap is required. The foregoing starting and stopping of the coil winding machine slows down production so that it is inefficient, and requires the continuous attention of an operator which makes it expensive.

The objects of the invention are to provide improved bobbins and electrical coil constructions along with methods of winding coils which greatly reduce the extent of operator intervention required during winding. In particular it is desired to eliminate the need to stop the machine and have the operator intervene to draw a loop and restart the machine for every tap in the winding.

SUMMARY OF THE INVENTION

The bobbin on which the coil is wound comprises a drum-like coil support portion extending along a winding axis and flanges extending normally to the axis. In accordance with the invention, at least one of the flanges has an outboard portion provided with a terminal-receiving cavity having slotted walls allowing a wire to extend and pass through the cavity in a circumferential direction relative to said axis. The direction of the wire through the cavity corresponds generally to that of the wire in the turns of the coil so that the wire may be guided through the cavity in a winding excursion beyond the one flange. Subsequently a terminal is inserted into the cavity to make electrical connection with the wire.

In a preferred embodiment of the invention intended for a reactor ballast winding requiring a single tap, start and finish terminal-receiving cavities are provided in outboard portions on one bobbin flange, and a tap terminal-receiving cavity is provided in an outboard portion on the other flange.

In a preferred embodiment of the invention intended for the windings of a lag transformer ballast whereof primary and secondary windings must be physically spaced apart in order to accommodate a magnetic shunt between them, start, junction and finish terminal-receiving cavities are provided on a bridging portion of a double bobbin which joins the primary winding support portion to the secondary winding support portion.

Other novel features of the core and coil assemblies are set forth in the detailed description which follows.

The method of our invention for making coil assemblies with these bobbins comprises winding turns of insulated wire under tension on the bobbin to make a coil, continuing to wind while guiding the wire under tension outboard of a flange, through the cavity and back into a winding portion of the bobbin, completing the winding and inserting a terminal having insulation penetrating means into the cavity to connect to the coil.

DESCRIPTION OF THE DRAWINGS

FIG. 1 is a plan view of a reactor bobbin embodying the invention.

FIG. 2 is an end view of the bobbin as seen on line 2—2 in FIG. 1.

FIG. 3 is a side view of the same bobbin.

FIGS. 4*a* and 4*b* are enlarged views of a terminal-receiving cavity seen on section lines AA and BB respectively in FIG. 5.

FIG. 5 shows in partly schematic form the complete reactor coil assembly.

FIG. 6 is a pictorial view looking down into the start chamber of the bobbin in the direction indicated by arrow 6—6 in FIG. 5.

DETAILED DESCRIPTION

Figure 7:
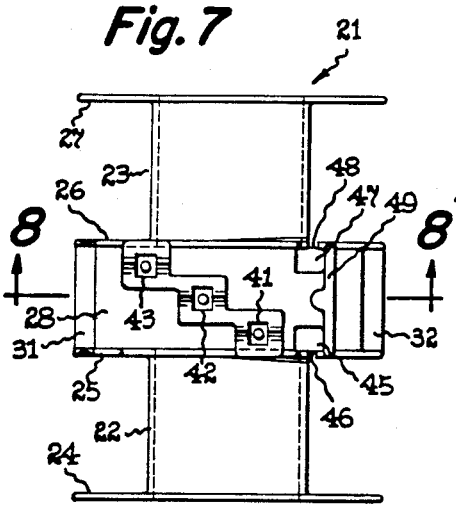
FIG. 7 is a plan view of a lag ballast double bobbin embodying the invention.

Referring to FIGS. 1–3, an electrical coil in accordance with one embodiment of the invention comprises a bobbin 1 having a square drum-like coil supporting surface 2 extending parallel to the winding axis and side flanges 3,4 normal to the coil supporting surface. The bobbin may be made by molding an insulating thermoplastic or thermo-setting material able to withstand the ballast operating temperature without deforming, for instance glass fiber-filled polyester or alternatively nylon. Flange 3 has two contact retaining means or terminal housings formed integrally therewith in the form of raised box-like portions 5,6 on the outboard side and flange 4 has a similar portion 7 on its outboard side. Each of said housings comprises a well-like cavity for accommodating a terminal which will couple to the wire by applying pressure to it sufficient to cut through the insulation and make contact. The illustrated housings have an open square top 8 and slotted V-notched side walls 9 with the slots extending from the open top down towards the level of the rim of the flanges. The slots allow the wire to be automatically guided through the cavity by an excursion of the wire guide or winding head outboard of the flange. While it may be desirable to slow down the machine during the outboard excursion of the wire, there is no interruption of the winding process requiring the intervention of an operator.

FIGS. 4*a* and 4*b* show details of the terminal-receiving cavities and of suitable terminals or solderless contacts 10 which are accommodated in them. In both views, magnet wire 11 is shown passing through the cavity at the bottom of the V-notches and resting on the surface of pin-like element 12 which is part of the plastic bobbin and extends up from the bottom of the cavity. The terminals 10 are of hard brass formed to a plate-like configuration with the lower end folded back up at 13 to form spaced parallel walls. The lower double-walled portion is bifurcated to form a slot 14 in each wall of the terminal extending up from the bottom. The slots in the terminals are in alignment with the slots or V-notches in the end walls 9 of the box-like cavities, the former slots facing down while the latter face up. When the terminal is pressed down into the cavity, the wire is gripped by the slots 14 in the terminal at the level of pin-like element 12. The width of the slots in the terminals is slightly less than the diameter of wire 11 in order to displace the varnish or coated insulation from the wire and squeeze it to assure good electrical contact. The upwardly directed barbs 15 in the edges of the terminal bite into the plastic cavity walls to retain the terminal in the cavity. The varnish which is applied to the finished assembly and baked also assures retention.

In the manufacture of the complete coil assembly 16 shown in FIG. 5, the wire 11*a* must be drawn through start cavity 5 and pulled down through start chamber 17 into start slot 18 in flange 3 as shown at 11*b*. When a rotating arbor type winding machine is used, the wire end 11*a* is fastened into the start cavity prior to winding. This may be facilitated by so dimensioning the slots or V-notches 9 in the cavity walls that the wire can be jammed into them to hold it in place, and additionally the terminal 10 can be pressed into the cavity prior to winding. As the spindle begins to rotate, the wire is guided under tension by the wire guide towards alignment with the inside edge of flange 3. Initially, the wire 11*a* has the direction indicated in dotted lines at 11 in FIG. 6, and as the spindle rotates, the wire slides off the curving end wall 19 of the start chamber 17 through the successive positions 11' and 11'' into the final position 11*b* within the start slot 18 as shown.

When a fixed arbor type winding machine is used, the end of the wire would normally be anchored externally of the bobbin when the winding head draws the wire through the start cavity 5, so that there is not the same need to jam the wire portion 11*a* into the slots or V-notches 9. As the winding head proceeds to wrap the wire around the bobbin, it guides the wire under tension towards alignment with the inside edge of the flange 3. The result is that the wire slides off the curving end wall 19 of the start chamber and ends up aligned with the start slot 18 in the same way previously described for the rotating arbor winder.

Whether using a rotating arbor or a fixed arbor, the coil is next precision wound with the wire under tension so that the turns are close laid side-by-side as indicated for a few turns at 11*c* in the first layer. As the layers of turns are built up, the turns are staggered in successive layers, that is, the turns are displaced laterally by half the width of a turn in successive layers in order to achieve closer packing. The dotted diagonal lines 11*d* represent the build up of turns up to the next to last layer which ends at flange 4. The wire guide or the winding head then takes the wire in a winding excursion 11*e* beyond flange 4 through tap cavity 7 without interrupting the winding pattern, and then winds the last layer represented by dotted diagonal lines 11*f*. The winding is terminated by passing the wire through finish cavity 6 as shown at 11*g*. The terminals 10 are then pressed into the cavities and the reactor may be completed in the usual way, after assembly with an iron core, by varnish impregnation and baking. The disposition of the terminal-receiving cavities 5, 6 and 7 so that they are all vertical and located at the same level facilitates automation of the terminal inserting operation, particularly when it follows winding done by wrapping the wire around a fixed bobbin.

In using the invention with multiple section bobbins which accommodate two or more coils on physically spaced apart winding portions, the terminal housings are preferably located on bridging sections extending between the flanges of the coil support portions. The several coils may be wound uninterruptedly, the wire being guided as part of the winding process through a terminal housing when passing from one winding portion to another. Terminals are inserted into these housings to provide taps or connections between the coils.

Figure 8:
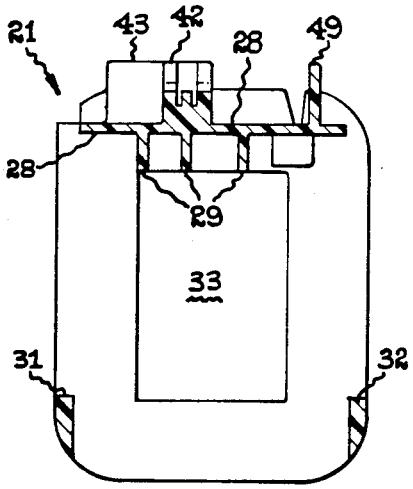
FIG. 8 is a sectioned end view of the double bobbin taken on lines 8—8 in FIG. 7.

Referring to FIGS. 7 to 12, a coil assembly in accordance with another emodiment of the invention intended for a lag ballast transformer comprises a double bobbin 21 having twin rectangular drum-like coil supporting portions 22 and 23 bounded by side flanges 24, 25 and 26, 27 respectively. The coil supporting portions 22 and 23 at the same time define the longitudinally extending major windows 33 as seen in FIG. 8. The twin portions are physically spaced apart by a bridging deck 28 having underlying brace sections 29, together with bridging sections 31 and 32 in each lower corner surrounding the major window 33. These sections assure good mechanical integrity without introducing thick sections which tend to cause warpage problems in curing the plastic. The long sides of flanges 25 and 26 define the minor windows 34 (FIG. 9) needed to allow the penetration of the shunts fixed to the core laminations, that is for the penetration of the central legs of the E-laminations. The double bobbin configuration in accordance with the invention as illustrated assures quick assembly and accurate placement of parts in manufacture.

Figure 10:
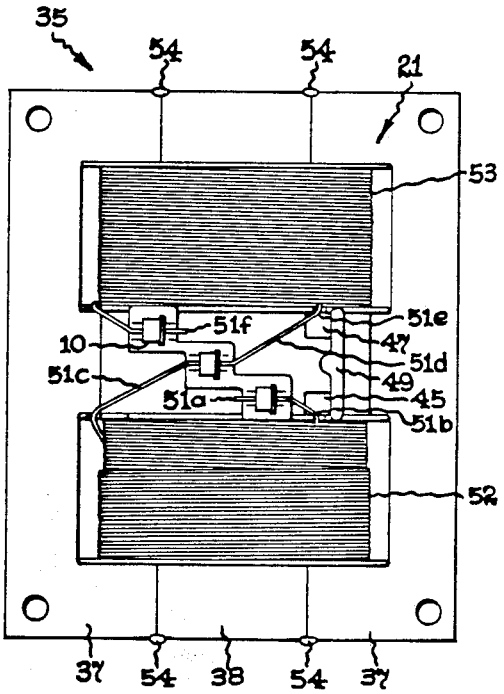
FIG. 10 is a plan view showing the complete lag ballast coil and core assembly.

The leakage reactance of the lag ballast transformer 35 illustrated in FIG. 10 is determined by the geometry of the fixed shunt, that is by the geometry involving the central leg 36 of the E-laminations 37 which span the main I-lamination 38 on both sides. The primary determinants of leakage reactance are the cross-sectional area of the central leg and the length of the air gap, dimension g in FIG. 12. Harmful saturation in the iron of the shunt causes harmonic voltage distortion and it is avoided by providing adequate cross-sectional area at the root of the central leg. According to a feature of the invention, the illustrated E-lamination 37 has a tapered central leg 36 which is wider at the root (dimension r in FIG. 12) than at the distal end (dimension d) next to the gap. This taper allows a complementary or matching reverse taper in the wall thickness of the inner flanges 25 and 26 of the bobbin which are made thicker at the base by sloping the outside, and thinner towards the periphery. The taper in the flange wall allowing greater thickness at the base results in a flange having substantially the same strength as one of uniform wall thickness corresponding to the thickness at the base. However this is accomplished without reducing the winding space within the flanges 24, 25 and 26, 27 so that the increase in the length of the E-laminations and of the I-laminations which would otherwise be required is avoided. The length of the laminations determines the overall size of the transformer and the cost of the iron going into it. It is a dimension which is carefully watched in order to maintain it at a minimum and the invention thus permits a valuable reduction in it. Furthermore the taper fit of the central leg of the E-laminations into the window 34 bounded by the flanges 25 and 26 greatly facilitates the assembly of the core with the bobbin after winding and avoids the need for additional clearance to prevent winding. Additional clearance would of course have entailed an increase in the length of the laminations and of the iron cost.

In double bobbin 21, the start, tap or junction, and finish terminal-receiving cavities 41, 42 and 43 are provided in raised box-like portions on bridging deck 28 between the two coil supporting portions, as clearly shown in FIG. 7. They correspond in function to the terminal-receiving cavities previously described with reference to single bobbin 1. A start chamber 45 is provided on one side of deck 28 for start slot 46 which leads into winding portion 22, and a similar start chamber 47 is provided on the other side of deck 28 for start slot 48 which leads into winding portion 23. Curving end wall 49 next to the start chambers curves down in both directions towards winding portions 22 and 23 to allow the wire to slide off into either start chamber.

In the manufacture of the coil assembly for the complete lag ballast shown in FIG. 10, the wire is drawn through start cavity 41 as shown at 51*a* and must be pulled down through start cbamber 45 into start slot 46. This is done of course before assembling the bobbin with the iron core. To achieve the desired result on a winding machine, the wire is guided under tension towards alignment with the inside edge of flange 25. Rotation of the bobbin on its spindle, or alternatively wrapping of the wire around the bobbin, causes the wire to engage curving end wall 49 and to slide off towards winding portion 22, finally bending down as shown at 51*b* through start chamber 45 into start slot 46. The primary coil is then precision wound with the wire under tension and the turns are close laid side-by-side and staggered in successive layers. Winding of the primary coil 52 ends at bobbin flange 25 and the wire guide or winding head then takes the wire in a winding excursion 51*c* passing through tap terminal-receiving cavity 42. Continuing the excursion as shown at 51*d*, the wire is guided under tension towards alignment with the inside edge of flange 26. As before, rotation of the bobbin, or alternatively, wrapping of the wire around the bobbin causes the wire to engage curving end wall 49. This time the wire slides off towards winding portion 23 as shown at 51*d*, and bends down as shown at 51*e* through start chamber 47 into start slot 48. The secondary coil 53 is now precision wound in the same manner as the primary coil. The last turn of the secondary coil is laid against inside flange 26 and winding is then completed by guiding the wire through the finish terminal-receiving cavity 43 as indicated at 51*f*.

Figure 9:
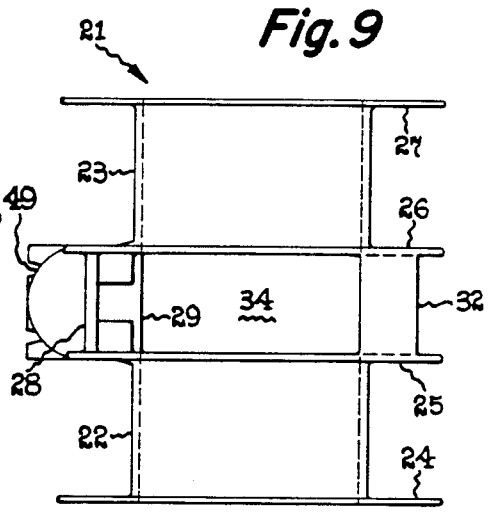
FIG. 9 is a side view of the same double bobbin.

When winding on a stationary bobbin, the terminals 10 are most conveniently pressed into the apertures 41, 42 and 43 by an automated plunger after winding has been completed. Thereafter the wound coil is assembled with a core by inserting a bound bundle of I-laminations 38 into major window 33, and juxtaposing a bound bundle of E-laminations 37 on either side with their central legs inserted into the minor windows 34 (FIG. 9). While tightly clamped together, the laminations are welded on the outside of their butting seams as indicated at 54 in FIG. 10. Finally the assembly is finished in known manner by impregnating with varnish and baking.

Figure 11:
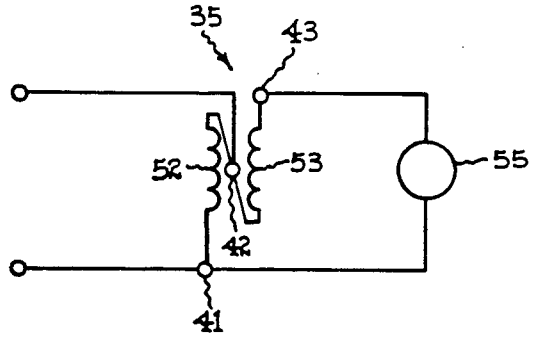
FIG. 11 is a schematic circuit diagram of the lag ballast.
Figure 12:
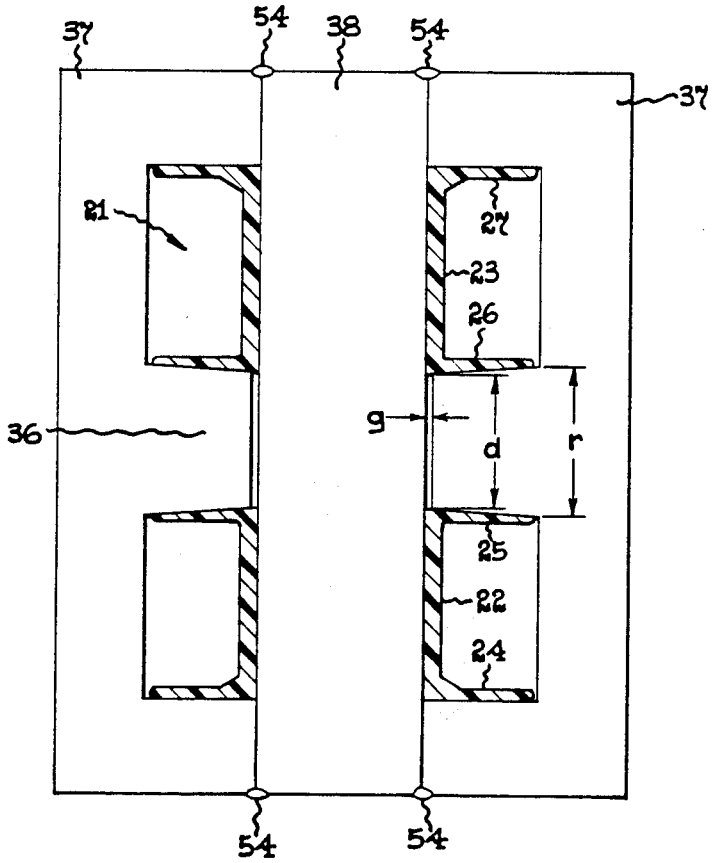
FIG. 12 is an enlarged plan view of an E-lamination butted against the I-lamination with the double bobbin in place for the lag ballast of FIG. 10 and illustrating the geometry about the shunt.

The manner of use of ballast transformer 35 is readily understood from the schematic circuit diagram of FIG. 11. Line voltage supplied to the terminals at 41 and 42 excites the primary winding 52. The primary voltage with the secondary voltage across winding 53 in series aiding therewith appears across the terminals at 41 and 43 to which a discharge lamp 55 is connected. The leakage reactance resulting from the presence of the magnetic shunt between primary and secondary windings serves to regulate the lamp current in the usual way.

It will be understood that the specific embodiments of the invention including the bobbin designs, coil configurations and winding methods which have been described in detail are intended to be representative of a wide variety which may be devised utilizing the principles of the invention. It is therefore desired that the invention not be limited to these embodiments, and it is intended to cover in the appended claims all modifications which those skilled in the art may make as fall within the spirit and scope of the invention.

What we claim as new and desire to secure by Letters Patent of the United States is:

1. A ballast transformer comprising:

a double bobbin of molded plastic insulating material forming a pair of physically spaced apart rectangular drum-like coil support portions surrounding a winding axis and defining longitudinally extending major windows, each of said support portions having side flanges extending radially outward relative to said axis, bridging sections extending between the inside ones of said flanges for maintaining the physical spacing of said support portions, said inside flanges forming the edges of transverse minor windows between said coil support portions, primary and secondary windings on said coil support portions, I-laminations extending through said major windows and inductively coupling said windings together, E-laminations spanning the I-laminations on both sides to complete the magnetic circuit, said E-laminations having central legs extending transversely toward the I-laminations through said minor windows to provide magnetic shunts between said windings.

2. A ballast transformer as in claim 1 wherein the wire in the two windings is uninterrupted, said bridging sections include a deck having three terminal housings thereon, one housing accommodating a terminal engaging the start of one winding, another housing accommodating a terminal engaging the finish of the other winding, and the other housing accommodating a terminal engaging the wire at a crossover from one winding to the other.

3. A ballast transformer as in claim 1 wherein the central legs of said E-laminations are tapered, being wider at the root and narrower at the distal end, and said inside flanges have a reverse taper in wall thickness complementary to that of said central legs.

* * * * *